US007313906B2

(12) United States Patent
Zhou et al.

(10) Patent No.: US 7,313,906 B2
(45) Date of Patent: Jan. 1, 2008

(54) YARN COMPRISING BAMBOO FIBER AND THE PROCESSING METHOD THEREOF

(75) Inventors: Xiangqi Zhou, Zhuzhou (CN); Zheng Liu, Zhuzhou (CN); Liming Liu, Zhuzhou (CN); Hao Geng, Zhuzhou (CN)

(73) Assignee: ZhuZhou Cedar Ramie Industrial Co., Ltd. (CN)

( * ) Notice: Subject to any disclaimer, the term of this patent is extended or adjusted under 35 U.S.C. 154(b) by 24 days.

(21) Appl. No.: 10/516,475

(22) PCT Filed: Nov. 24, 2003

(86) PCT No.: PCT/CN03/00997

§ 371 (c)(1),
(2), (4) Date: Jul. 25, 2005

(87) PCT Pub. No.: WO2004/076728

PCT Pub. Date: Sep. 10, 2004

(65) Prior Publication Data

US 2006/0059884 A1 Mar. 23, 2006

(30) Foreign Application Priority Data

Feb. 27, 2003 (CN) ..... 031182128

(51) Int. Cl.
*D02G 3/02* (2006.01)

(52) U.S. Cl. ..... 57/252

(58) Field of Classification Search ..... 57/252, 57/256; 19/0.3, 0.46
See application file for complete search history.

(56) References Cited

U.S. PATENT DOCUMENTS

| | | | | |
|---|---|---|---|---|
| 5,876,649 | A * | 3/1999 | Ryan | 264/136 |
| 5,948,712 | A * | 9/1999 | Tanabe et al. | 442/411 |
| 5,980,672 | A * | 11/1999 | Ryan | 156/169 |
| 2003/0056484 | A1* | 3/2003 | Oda | 57/28 |
| 2004/0176008 | A1* | 9/2004 | Lampe | 57/28 |
| 2006/0021387 | A1* | 2/2006 | Chuang et al. | 66/8 |

FOREIGN PATENT DOCUMENTS

GB 296333 A 8/1928

* cited by examiner

*Primary Examiner*—Shaun R. Hurley
(74) *Attorney, Agent, or Firm*—Bachman & LaPointe, P.C.

(57) ABSTRACT

A yarn comprising natural bamboo fiber and the method for producing the same is disclosed, wherein said yarn is prepared by spinning natural bamboo fibers alone or in combination with other fibers in a blended ratio of natural bamboo fibers comprising 30 to 100% by weight and other fibers comprising 70 to 0% by weight.

9 Claims, 5 Drawing Sheets

YARN COMPRISING BAMBOO FIBER AND THE PROCESSING METHOD THEREOF

TECHNICAL FIELD

The present invention relates to yarn and the method for producing the same, specifically the yarns comprising pure natural bamboo fiber alone or combined with other textile fiber as well as the method for producing the same.

BACKGROUND

Bamboo possesses a long and ancient history in China. It has not only been given recognition by the writers and arts in history, but also offered people abundant resources for their life including clothes, food, household goods, vehicles, and entertainment. The wide application of bamboo in people's working, life and activity etc. has been thought much of by people all over the world. Nowadays, bamboo concerns people closely in their everyday life and plays an important role in society economic construction. Recently, it is a new topic for discussion in the application of bamboo resource that natural bamboo fiber can be used to spin and weave. As a natural fiber that comes from a green plant, with abundant resource and fine quality, bamboo fiber is a class of new and natural fiber. The exploitation and application of bamboo in textile industry is an important task that shows historic significance and social interest. Therefore, many enterprises and people on scientific research have been seeking for the aim on how to make the natural bamboo textile product going on wheels as soon as possible, no matter on scientific research, on manufacture and on sales market. The twenty-first century is an era seeking environment protecting. Natural bamboo fiber, as a kind of new green environment friendly natural fiber, takes on un-resistant attraction. That is not only because it is green and natural, but due to its unique merits in the properties such as anti-bacteria, wearability, moisture absorption and gas permeability that other fibers don't have. On the basis that there is uncountable lumen distribution on the cross section of bamboo fibers, bamboo fibers can absorb or evaporate moisture instantly. Therefore, "Breathing Fiber" is a name given to natural bamboo fiber. People would favor bamboo fibers as a new material of textile. The so-called "bamboo fibers" textiles in the market at present are exactly articles made of viscose fibers produced from bamboo pulp sheets (China Patent No. ZL02113106.6). The characteristic of natural bamboo fibers in such bamboo rayon product has been greatly destroyed and the bamboo fibers existed in yarns have essentially lost the excellent characteristic of natural bamboo fibers, thus, the authoritative organization don't admit that the bamboo rayon product is an article of natural bamboo fibers.

China Patent No. ZL02111380.7 disclosed a process to produce real natural bamboo fibers that can efficiently keep the excellent merits of bamboo fibers. To differentiate the fiber from the rayon one, the fiber is called natural bamboo fiber. The success in getting natural bamboo fiber laid a good foundation of manufacturing natural bamboo textile products. However, the fibers produced according to the process of this patent cannot be directly used in spinning, for the reason of its poor cohesion, low yarn strength and being changed much with the environment. There are many technical problems to be solved on how to produce yarns and fabric with natural bamboo fibers. There still exists the need to do more research work on bamboo fibers.

SUMMARY OF THE INVENTION

An object of the present invention is to provide natural bamboo yarns that can not only keep the original characteristics of natural bamboo fibers, but also meet the demands of textile products. Another object of the present invention is to provide a process for producing the natural bamboo yarns.

The above objects of the present invention are achieved by the following means. Firstly, impurities such as lignin and pectin are removed from bamboo (generally Mao bamboo) by treating it with natural agent. In one embodiment, the obtained fiber is the natural bamboo fiber in a state of filament that is produced according to the process as disclosed in China Patent No. ZL02111380.7. In another embodiment, the obtained fiber is the natural bamboo fibers in a state of processed fibers formed by allowing a certain amount of lignin and pectin to remain on purpose. In order to improve the spinning properties of natural bamboo fibers and strengthen the properties of dispersion and collecting, the natural bamboo fibers are further subjected to a treatment which can improve the spinnability. The natural bamboo fibers are treated by providing oil (emulsification oil) and then drying. Then, the obtained fibers are treated by humidifying and providing oil. The natural bamboo fibers which can be spun are thereby obtained after stacking a period of time. Spinning of the natural bamboo fibers can be conducted alone or in combination with other textile fibers. Various pure natural bamboo yarns or blending yarns can be obtained by the process such as ramie spinning system, cotton spinning system, silk spinning system, wool spinning system or linen spinning system. The main technical points of the present invention are as following:

(1) The yarn is prepared by spinning natural bamboo fibers alone or in combination with other fibers (such as terylene, nitrile, ramie, wool, Tencel, rayon, cotton, silk and modal etc) in a blended ratio of natural bamboo fibers comprising 30 to 100% by weight and other fibers comprising 70 to 0% by weight.

(2) In said yarn, said natural bamboo fiber comprises a natural bamboo fiber in a state of filament, or a natural bamboo fibers in a state of processed fibers formed by allowing a certain amount of lignin and pectin to remain on purpose.

(3) In said yarn, said natural bamboo fiber mainly has the following technology index:

| | The natural bamboo fiber in a state of filament | The natural bamboo fiber in a state of processed fibers |
|---|---|---|
| Fiber count | 1200 Nm~2000 Nm | More than 500 Nm |
| Fiber strength | 3~5.5 CN/D | 3~5.5 CN/D |
| Average fiber length | 30~100 mm | 30~100 mm |
| Nep | Less than 5/g | |
| Thick ratio | Less than 0.5% | |

(4) The process for manufacturing the natural bamboo yarn comprises preliminary producing step of the natural bamboo fiber (according to known technology), the step of improving the spinnability of natural bamboo fiber and the step of spinning. It should be noted that the step of improving the spinnability of natural bamboo fiber is the most important.

(5) In the above-mentioned process, the step of improving the spinnability of natural bamboo fiber comprising:

a. obtaining natural bamboo fiber according to known technology such as disclosed in China Patent No. ZL02111380.7;

b. selecting natural bamboo fiber; in which the requirements for selecting natural bamboo fiber are that the fiber should be straight and order; wherein the technology index of the natural bamboo fiber are consistent with those cited in the above item (3);

wherein the weight of fiber bundle changes in various species;

c. providing oil to the natural bamboo fiber; in which the oil is a mixture of soap with emulsification oil, wherein the amount of emulsification oil is 1 to 1.8% by weight and the amount of soap is 0.5 to 0.9% by weight, both based on the weight of natural bamboo fiber; the oil is provided by immersing the fiber into oil after humidifying treatment at a temperature of 80~90° for 3~4 hours in a bath ratio of 1:6~8; wherein the emulsification oil comprises 47~53% by weight of plant oil, 0.04~0.06% by weight of sodium hydroxide and 47~53% by weight of water; and said plant oil has a acid number of less than 8, a saponification number of 185~195 and an iodine value of 76~83;

d. drying the natural bamboo fiber in dryer after dehydrating it, the moisture regained after drying is 5~9% by weight;

e. humidify by spraying and providing oil for the natural bamboo fiber after the drying step, wherein the oil comprises 9~10.6% by weight of kerosene, 0.3~0.5% by weight of sodium carbonate, 6~7.6% by weight of plant oil and 83~84% by weight of water;

f. stacking the natural bamboo fiber for 5~7 days after humidifying, the moisture of the fiber regained is 10~15%.

(6). Spinning the natural bamboo fiber by the methods selected from the group consisting of:

i. the technology of ramie spinning system in which the length of fiber is from 70 mm to 100 Mm, as shown in FIG. 1.

ii. the technology of cotton spinning system in which the length of fiber is from 30 mm to 50 mm, as shown in FIG. 2.

iii. the technology of silk spinning system in which the length of fiber is from 65 mm to 100 mm, as shown in FIG. 3.

iv. the technology of wool spinning system in which the length of fiber is from 65 mm to 100 mm, as shown in FIG. 4.

v. the technology of linen spinning system in which the length of fiber is from 50 mm to 100 mm, as shown in FIG. 5.

(7). the draw ratio is controlled between 5 and 10 in the step of slivering, drawing and roving; (8). in the slivering step, fiber is fed at low speed, with little fix quantity and proper tension. The treatment aims to align fiber further and avoid fiber damage.

(9) in the combing step, fiber is fed at low speed, with little fix quantity. Different technology scheme is used depending on different material quality. The draw gauge is 28~48 mm. The treatment aims to eliminate short fiber and some faults so as to get higher count yarn.

(10) in the drawing step, sliver is fed at low speed, with little fix quantity, weighty press, small diameter cone-shaped. The treatment aims to improve the sliver evenness and smoothness, ensure uniform mixing and make it shaped well.

(11). in the roving step, sliver is fed at low speed, with little fix quantity, higher twist, keep soft and not broken.

(12) in the spinning step, sliver is fed at low speed, with little draw force, given proper press and proper tension and draw gauge. The treatment aims to decrease hair, reduce breaking, increase yarn regularity and reduce strength unevenness.

(13). During spinning step, a high environmental temperature and humidity is kept. For example, the temperature is from 22 to 30° C. and the relative humidity is from 70 to 90%;

(14). the draw ratio is controlled between 10 and 30 in spinning step (changing with species);

(15). doubling and twisting natural bamboo fiber yarn or bamboo blended yarn, forming multiplied yarn (changing with the use of article);

(16). In general, the natural bamboo fiber and other fibers are blending by sliver blended, little fix quantity blended or bundle blended.

Natural bamboo yarn and bamboo blended yarn produced according to the present invention have excellent gloss and high strength after evaluating the properties of natural bamboo fiber. The fineness of the natural bamboo fiber in a state of filament is in the range of about 1200 to 2000 denier, and the fineness of the natural bamboo fibers in a state of processed fibers is about 500 denier and more. The length of fiber can be changed depending on specific requirements. Numerous fine grooves existing on the surface of the natural bamboo fiber are advantageous to improve the function of moisture absorption and moisture evaporation. Fine gaps between the fibers are kept no matter how the fiber is bent and pressed and thus capillary effect is maintained in any cases. Therefore, it is very suitable to use it as fabrics in spring clothing and summer clothing. The use of natural bamboo fiber in summer clothing is advantageous to vaporize sweat from body surface and avoid the comfortlessness resulted from sweating. Furthermore, the evaporation of sweat can remove heat from body surface. The raw material bamboo used in the present invention is widely grown in Asia such as in China and Japan and is readily obtained. The yarn comprising natural bamboo fiber according to the present invention is environment-friendly and biodegradable.

Moreover, the natural bamboo fibers can be spun alone or in combination with other fibers. The obtained yarns comprise 36 Nm pure natural bamboo fiber yarn for weaving or knitting, 24 Nm pure natural bamboo fiber yarn for weaving or knitting, 45 Nm blended yarn of natural bamboo fiber and water-soluble fiber (74% natural bamboo fiber and 40% water-soluble fiber), 68 Nm blended yarn of natural bamboo fiber and terylene (35% natural bamboo fiber and 65% terylene), 51 Nm blended yarn of natural bamboo fiber and ramie (70% natural bamboo fiber and 30% ramie), 13.5 Nm pure natural bamboo fiber knot yarn, 80 Nm blended yarn of natural bamboo fiber and silk (50% natural bamboo fiber and 50% silk), 50 Nm/2 blended yarn of natural bamboo fiber and wool (60% natural bamboo fiber and 40% wool), and 15 Nm pure natural bamboo fiber yarn.

ILLUSTRATION OF THE FIGURES

EXAMPLES

Example 1

Figure 1:
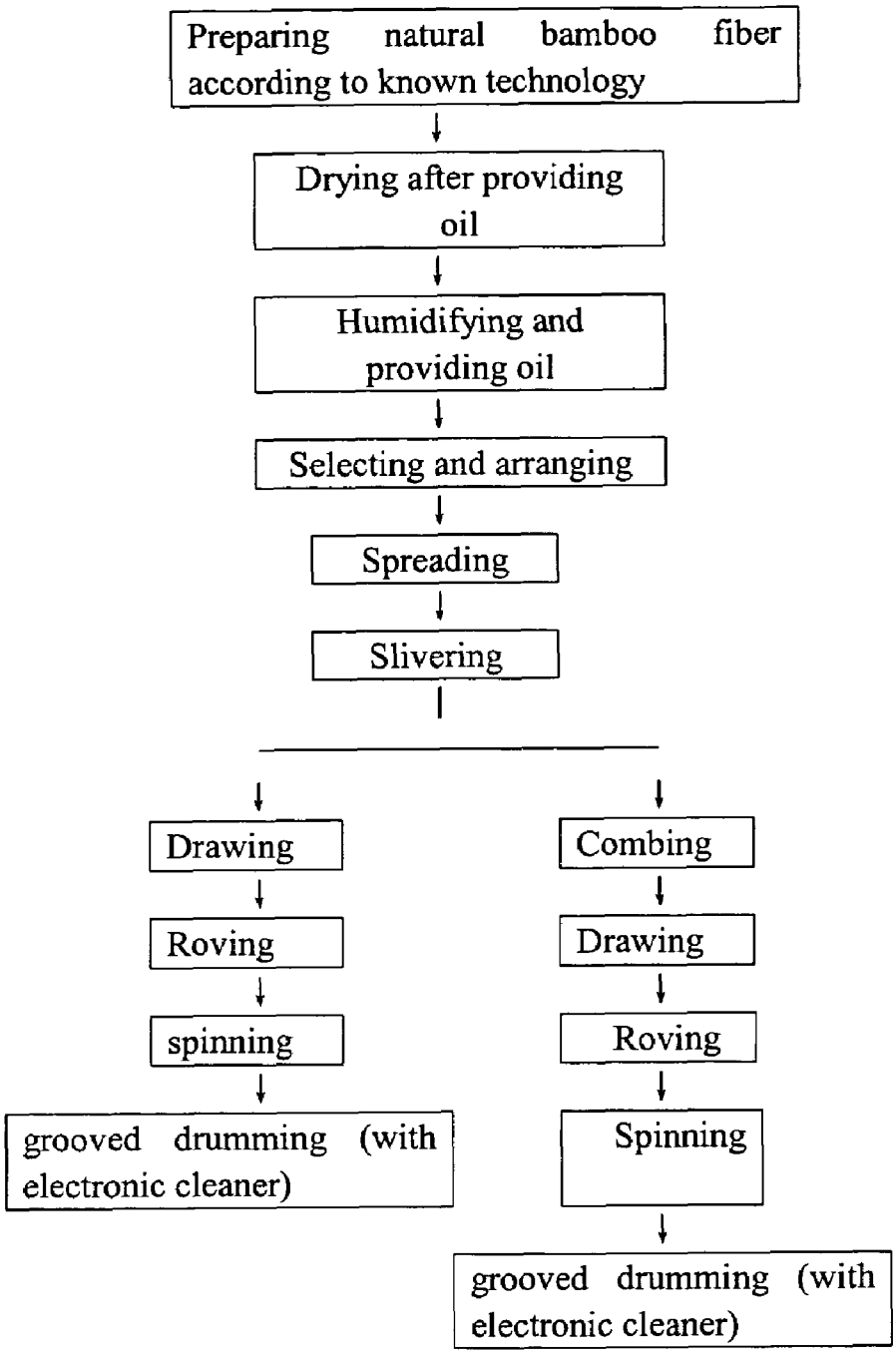
FIG. 1 is a schematic diagram of a process in which ramie spinning system is used according to an embodiment of the present invention.
Figure 2:
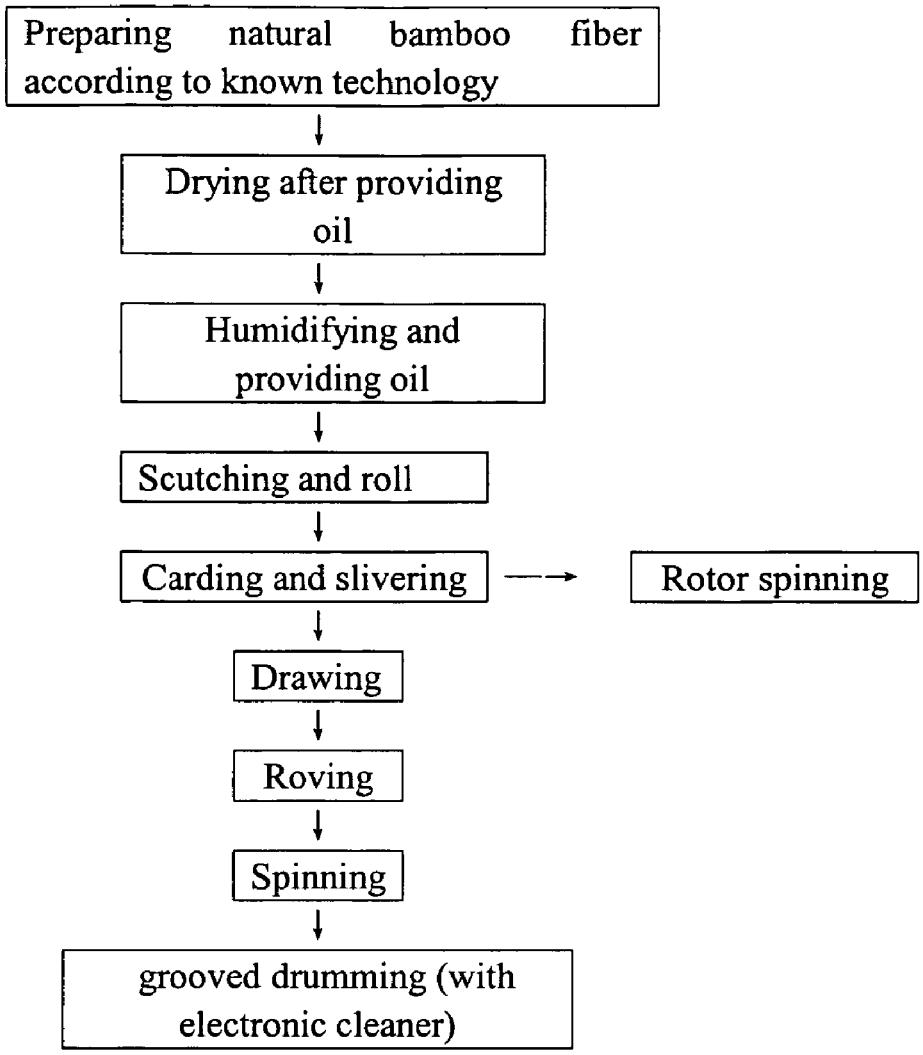
FIG. 2 is a schematic diagram of a process in which cotton spinning system is used according to an embodiment of the present invention.
Figure 3:
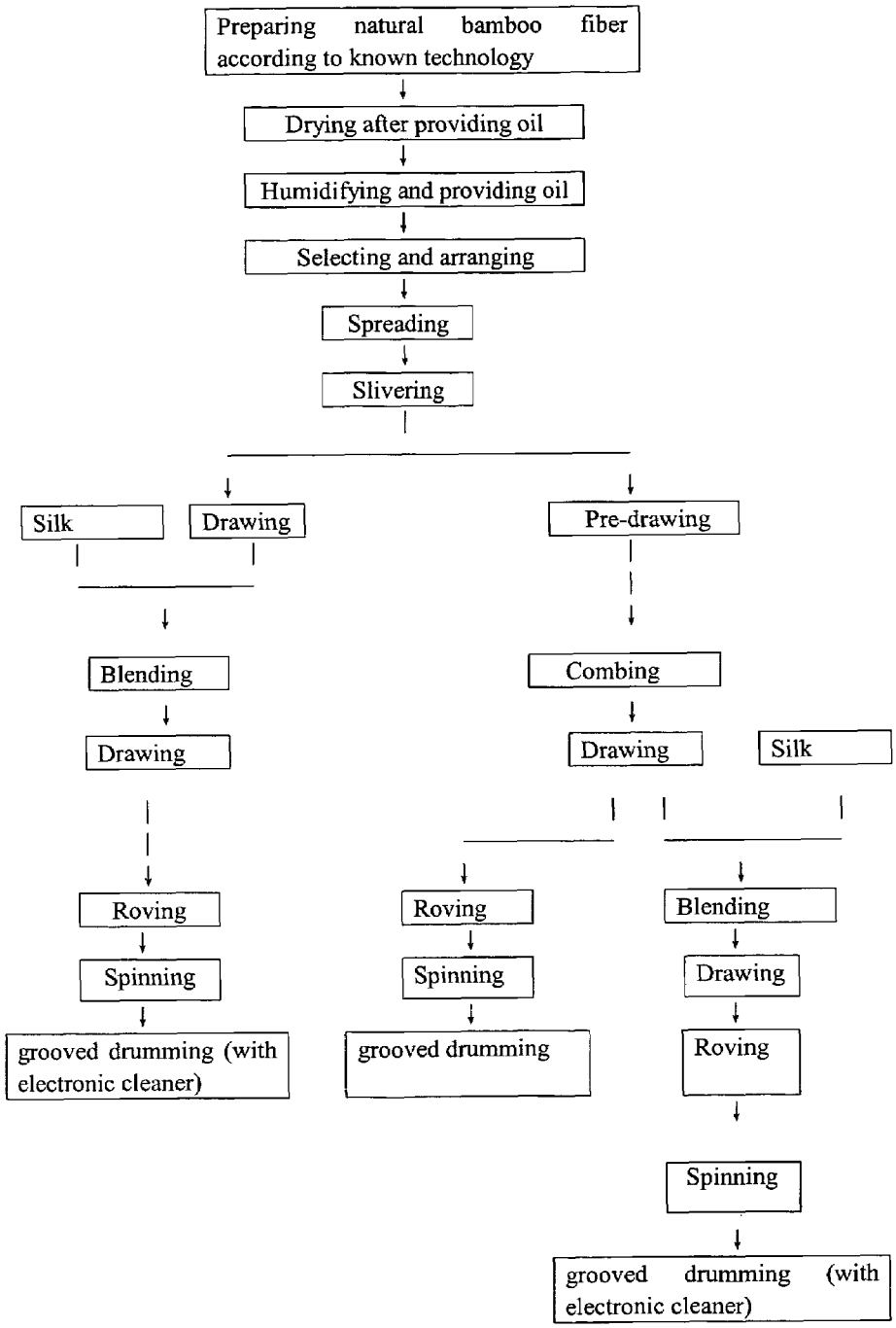
FIG. 3 is a schematic diagram of a process in which silk spinning system is used according to an embodiment of the present invention.
Figure 4:
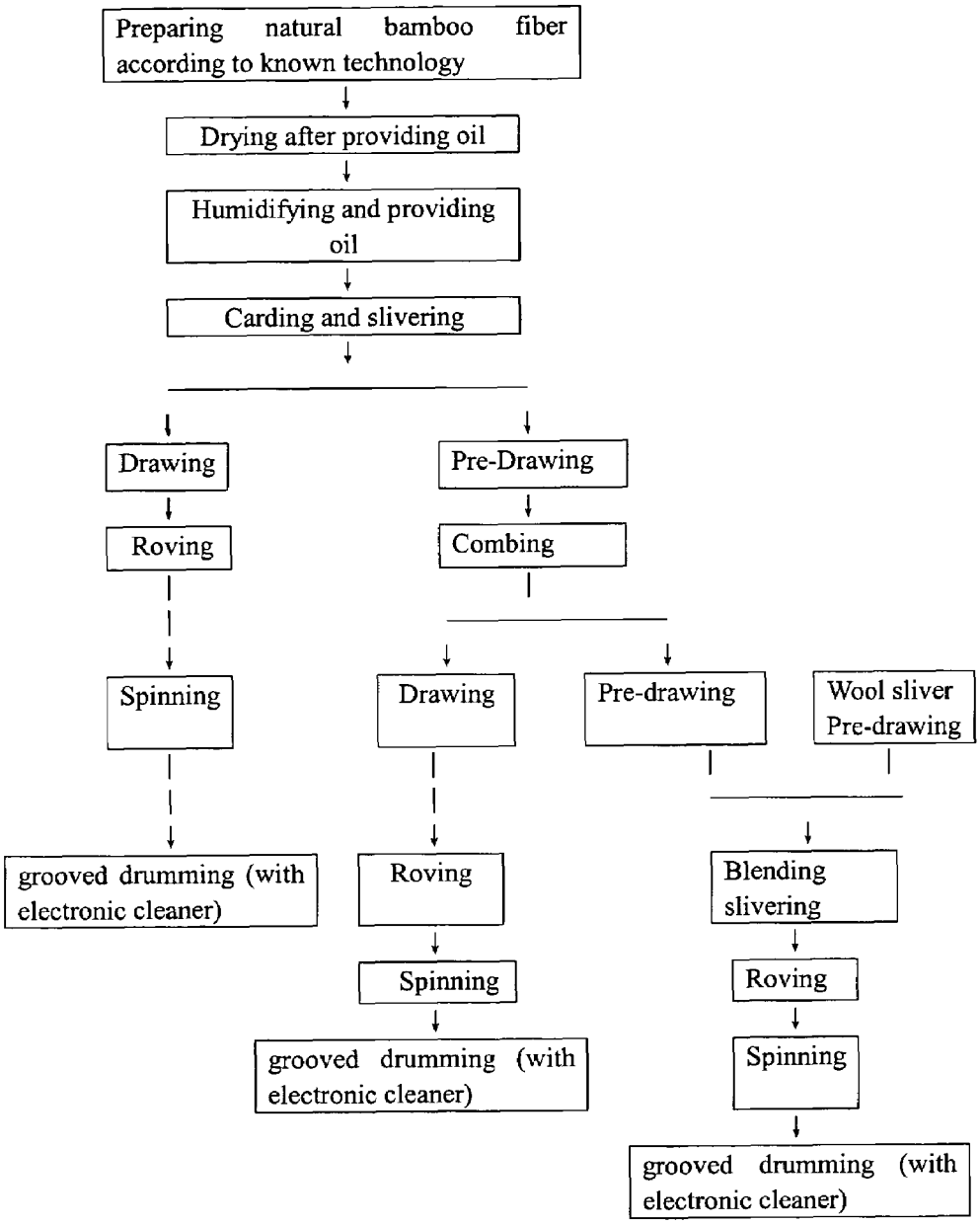
FIG. 4 is a schematic diagram of a process in which wool spinning system is used according to an embodiment of the present invention.
Figure 5:
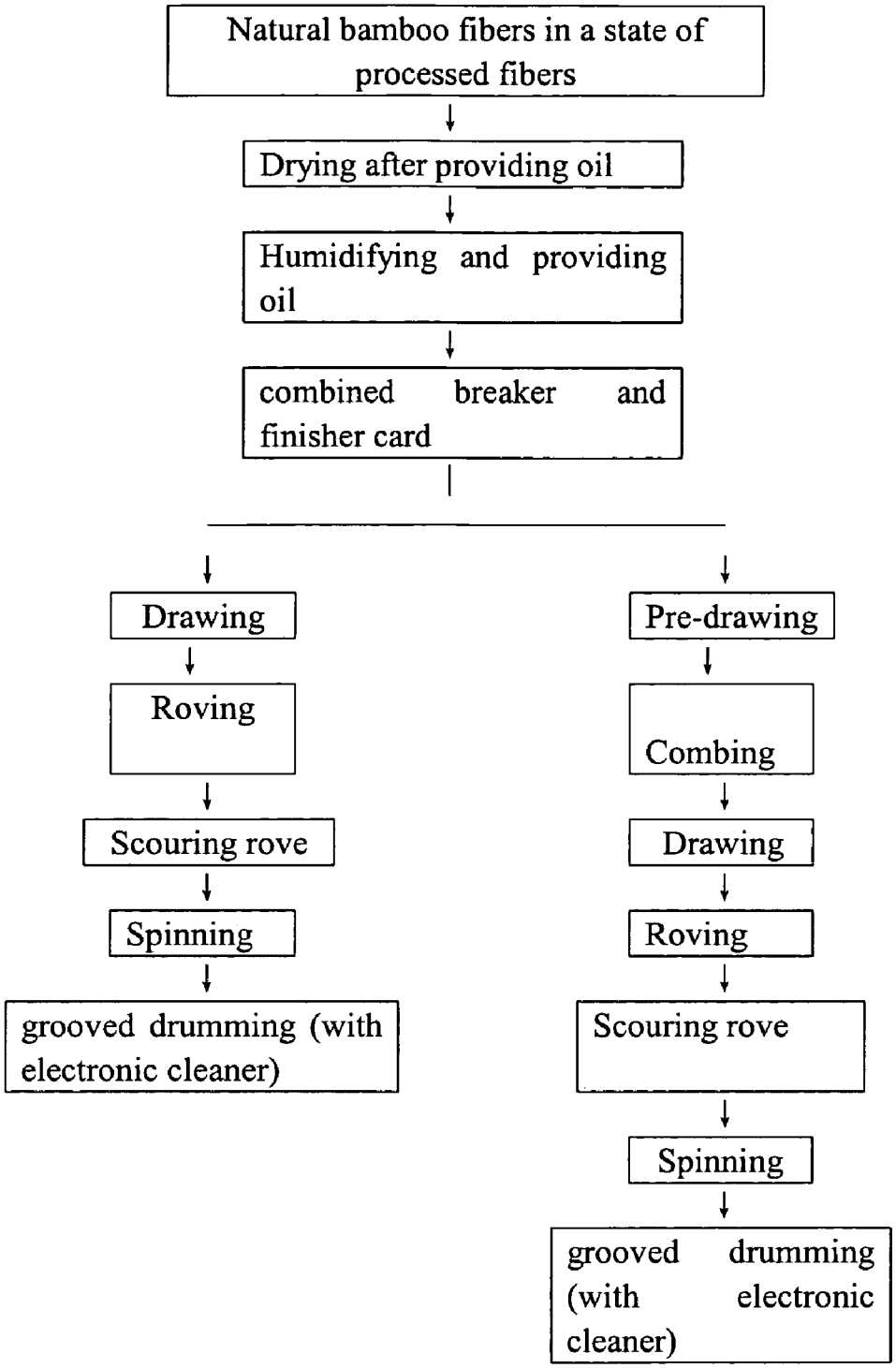
FIG. 5 is a schematic diagram of a process in which linen spinning system is used according to an embodiment of the present invention.

The Production of 24 Nm Pure Natural Bamboo Yarn

The treatment conditions according to the technology of ramie spinning system are described as below.

1. obtaining natural bamboo fiber according to known technology such as disclosed in China Patent No. ZL02111380.7;

2. improving the spinnability of the natural bamboo fiber;

A. providing oil to the natural bamboo fiber; in which the oil is provided by immersing the fiber into oil after humidifying treatment at a temperature of 80~90° C. for 3~4 hours in a bath ratio of 1:6~8, wherein the amount of emulsification oil is 1.4% by weight and the amount of soap is 0.8% by weight, both based on the weight of natural bamboo fiber.

wherein the emulsification oil comprises 49.95% by weight of tea oil, 0.05% by weight of sodium hydroxide and 50% by weight of water. And the tea oil has an acid number of less than 8, a saponification number of 185~195 and an iodine value of 76~83.

B. Dehydrating and drying the natural bamboo fiber, the moisture regained after drying is 5~9%.

C. humidify by spraying and provide oil for the natural bamboo fiber after the drying step, wherein the oil comprises 10% by weight of kerosene, 0.4% by weight of sodium carbonate, 6.6% by weight of tea oil and 83% by weight of water.

D. stacking the natural bamboo fiber for 5~7 days after humidifying, the moisture of the fiber regained is 10~15%.

3. selecting the fiber after humidifying and stacking the fiber;

The weight of bundle of fiber after selecting is 65.+−0.5 g and the requirements for selecting are as follows:

Count: 1200~2000 Nm;
Strength: 4~5.5 CN/D
Average length: 80~100 mm
Factor of changing length: 40-45%
Nep: less than 5/g
Thick: less than 0.5%

4. Spreading the bundle of fiber twice under the condition of:

Spreading machine: 225 g/kont
Needle comb strike times: 409/minute
Needle comb specification: 18 needles/inch
Draw ratio at the back: 1.017

5. Slivering the bundle of fiber under the condition of:

Needle comb strike times: 390/minute
Needle comb specification: 18 needles/inch
Draw ratio at the back: 0.97
Draw ratio in the front: 1.095

6. Pre-drawing the bundle of fiber under the condition of:

Needle strike times: 390/minute
Needle comb specification: 13~18 needles/inch
Draw ratio at the back: 1.02
Draw ratio in the front: 1.04
Weight of outlet sliver: 40~45 g/5 m 7.Combing after pre-drawing under the condition of:

Speed of cylinder: 90~95/minute
Draw gauge: 38~48 mm
Weight of outlet sliver: 40~45 g/5 m 8.Drawing the bundle of fiber under the same condition as those in item 6.

9. First roving under the condition of:

Speed of front roller: 175 rpm
Speed of spindle: 300 rpm
Twist factor: 21
Draw ratio: about 8

10. Second roving under the condition of:

Speed of front roller: 58~70 rpm
Speed of spindle: 450 rpm
Draw ratio: about 8

11. Spinning under the condition of:

Speed of front roller: 99 rpm
Speed of spindle: 6250 rpm
Draw ratio: 17

In this example, natural bamboo fiber bundles are prepared by selecting, arranging, spreading, slivering, pre-drawing and combing the natural bamboo fiber by means of ramie spinning device after said fiber being treated to improve spinnability, and then yarns are prepared by drawing, roving and spinning.

Example 2

The Production of 60 Nm Blended Yarn of Natural Bamboo

Fiber and Water-Soluble Fiber

The blend ratio of the yarn is 60% natural bamboo fiber and 40% water-soluble fiber.

The treatment conditions according to the technology of ramie spinning system are described as below.

1. obtaining natural bamboo fiber according to example 1.

The requirements for selecting natural bamboo fiber are that the fiber should be straight and order, and the thick fault is less than 0.3%. The weight of fiber bundle changes in various species.

2. improving the spinnability of natural bamboo fiber according to example 1.

3. selecting the fiber after humidifying and drying the fiber

The weight of bundle of fiber after selecting is 65.+−0.5 g.

4. Spreading the bundle of fiber twice under the condition of:

First spreading:
Knotting: 225 g/knot
Needle comb specification: 18 needles/inch
Needle comb strike times: 409/minute
Second spreading:
Knotting: 225 g/knot
Needle comb specification: 18 needles/inch
Needle comb strike times: 409/minute 5. Slivering the bundle according to example 1 under the condition of:

Sliver weight: 45~50 g/5 m
Needle comb specification: 18 needles/inch
Needle comb strike times: 309/minute 6. Drawing the natural bamboo fiber sliver together with water-soluble fiber sliver under the same condition as in Example 1.

The water-soluble fiber sliver has a count of 6000 Nm and more, and an average length of 90 mm and more.

Dissolving temperature: starting to dissolve at 88° C. and dissolved completely at 100° C.

7. Roving the Blended Sliver

The sliver is fed at low speed, with little fix quantity, suitable twist, keep soft and not broken.

8. Spinning

Sliver is fed at low speed, with little draw force, given proper press and proper tension and draw gauge. The treatment aims to decrease hair, reduce breaking, increase yarn regularity and reduce strength unevenness.

9. During spinning step, a high environmental temperature and humidity is kept.

For example, the temperature is from 22 to 30° C. and the relative humidity is from 70 to 90%. [0124] Drawing ratio in slivering, drawing and roving steps is about 8 or more and the drawing ratio in spinning step is about 15~20.

Example 3

The Production of 13.5 Nm Pure Natural Bamboo Yarn

The treatment conditions according to the technology of cotton spinning system are described as below.

1. obtaining natural bamboo fiber according to example 1.

The natural bamboo fiber (short spin technology) has a fiber count of 1200~2000 Nm, a fiber strength of 3~5.5 CN/D, an average length of 30~50 mm and a thick faults of less than 1%.

2. improving the spinnability of natural bamboo fiber according to example 1.

3. packing the treated natural bamboo fiber.

4. rolling the fiber on the scotching machine under the condition of:

The gauge between dust bar is 7 mm

The gauge between striker and dust bar (inlet/outlet) is 8 mm/18 mm

Speed of the cotton roll roller: 13 rpm

Speed of the striker: 1000 rpm

The dry measured amount of cotton roll: 400 g/m 5. carding the rolled natural bamboo fiber into sliver in carding machine under the condition of:

The gauge between needle roller and dust blade: 15/1000 (inch)

The gauge between cylinder and needle roller: 7/1000 (inch)

The gauge between cylinder and flat (from inlet to outlet) is 14/1000 inch, 12/1000 inch, 12/1000 inch, 12/1000 inch and 14/1000 inch respectively The gauge between cylinder and doffer: 5/1000 inch Doffer speed: 16.6 rpm Cylinder speed: 360 rpm Needle roller speed: 1070 rpm Flat speed: 177 mm/min The dry measured amount of outlet sliver: 24 g/5 m 6. The main technology parameters in drawing are:

The number of the slivers fed in: 8

The dry measured amount of outlet sliver: 21~22.5 g/5 m

Draw ratio: 7~9

Speed of the front roller: 1300~1470 rpm

The gauge in the front: 14 mm

The gauge at the back: 22 mm

7.The main technology parameters in roving are:

The dry measured amount of outlet sliver: 10.2 g/10 m

Twist factor: 37.2

Speed of the front roller: 157 rpm

Spindle speed: 480 rpm

Draw ratio at the back: 1.18

8.The main technology parameters in spinning are:

Twist factor: 140

Draw ratio at the back: 1.33

Speed of the front roller: 176 rpm

Spindle speed: 7330 rpm

Gauge between two roller center:

From front roller to middle roller: 45 mm

From front roller to back roller: 100 mm

Slip notch: 15.times.0.7 mm for normal yarn 15.times.2 mm for slub yarn the type of equipment that can produce slub is YTC83-SM 9. the main technology parameters in rotor spinning are:

Comb roller speed: 7500 rpm

Rotor speed: 3100 rpm

Sector angle in separating plate: 45° the type of needle roller: OK40

Twist factor: 150

10. Cotton length bamboo natural fiber and other cotton length fiber are blended by pack blending or sliver blending.

11. During spinning step, a high environmental temperature and humidity is kept. For example, the temperature is from 20 to 30° C. and the relative humidity is from 60 to 80%.

12. The principle of opening and cleaning is to loose fiber, not to beat fiber.

13. The carding is characterized in low speed, mainly aiming to transfer fiber and the carding gauge is relatively wide to avoid the damage of fiber.

14. In the drawing step, in order to increase the sliver evenness, the sliver is fed in low speed, with weighty press and the draw ratio is a little more than the number of drawing sliver.

15. The twist factor of roving and spinning is slightly high in favor of improving the strength of yarn.

16. The roller in drawing frame and roving frame and spinning frame should be covered with complex elasticity textile to decrease the fiber inwinded.

In this example, filaments produced during the combing step or filaments produced as required by spinning are subjected to clear, scotch, roll, comb, draw, rove and spin (or rotor spinning) by means of cotton spinning device.

Example 4

The Production of 80 Nm Blended Yarn of Natural Bamboo Fiber and Silk Fiber

The blend ratio of the yarn is 50% natural bamboo fiber and 50% silk fiber.

The treatment conditions according to the technology of silk spinning system are described as below.

1. obtaining natural bamboo fiber according to example 1.

The requirements for selecting natural bamboo fiber are that the fiber should be straight and order, and the thick fault is less than 0.3%. The weight of fiber bundle changes in various species.

2. improving the spinnability of natural bamboo fiber according to example 1.

3. selecting the fiber after humidifying and drying the fiber [0189] The weight of bundle of fiber after selecting is 65.+−0.5 g.

4. Spreading the bundle of fiber twice under the condition of:

First spreading: Knotting: 200 g/kont

Needle comb specification: 18 needles/inch

Needle comb strike times: 409/minute

Second spreading: Knotting: 200 g/knot

Needle comb specification: 18 needles/inch

Need comb strike times: 409/minute

5. Slivering the bundle according to example 1 under the condition of:

Outlet sliver weight: 40~45 g/5 m

Needle comb specification: 18 needles/inch

Needle comb strike times: 309/minute

6. Pre-drawing once the bundle after slivering under the condition of:

Outlet sliver weight: 40~45 g/5 m

Needle comb specification: 13 needles/inch

Needle comb strike times: 390/minute

7. Combing the bundle after pre-drawing under the condition of:

Speed of cylinder: 92~95/minute

Draw gauge: 38~45 mm

Weight of outlet sliver: 40~45 g/5 m

8. Pre-drawing under the same condition as in above item 6.

9. Blending with the silk and drawing under the condition of:

Draw ratio at the back tension: 0.96

Draw ratio in the front tension: 1.02

Needle comb strike times: 390/minute

Need comb specification: 13~16 needles/inch

10. Roving under the condition of:

Outlet count: 3.5~4 Nm

Speed of spindle: 55 rpm

Twist factor: 21

Draw ratio: about 8 or more

11. Spinning under the condition of:

Outlet count: 80 Nm

Speed of spindle: 6250 rpm

Twist factor: 80

Draw ratio: 20~24

12. During spinning step, a high environmental temperature and humidity is kept. For example, the temperature is from 20 to 30° C. and the relative humidity is from 65 to 80%.

In this example, natural bamboo fiber bundles are prepared by spreading, slivering, pre-drawing and combing the natural bamboo fiber by means of silk spinning device after said fiber being treated to improve spinnability, and then yarns are prepared by blending with spun silk, roving and spinning.

Example 5

The Production of 50 Nm/2 Blended Yarn of Natural Bamboo Fiber and Wool Fiber

The blend ratio of the yarn is 60% natural bamboo fiber and 40% wool fiber.

The treatment conditions according to the technology of wool spinning system are described as below.

1. Producing and treating the natural bamboo fiber according to items 1 and 2 in example 1.

2. Selecting the natural bamboo fiber after humidifying.

The selected natural bamboo fiber has a fiber count of more than 1500 Nm, fiber strength of more than 4 CN/D, fiber average length of 65~100 mm and thick ratio of less than 0.5%.

3. carding the natural bamboo fiber in carding machine to prepare sliver under the condition of Speed of cylinder: 148 rpm Speed of doffer: 15 rpm Weight of outlet sliver: 15.+−0.1 g/m 4. Pre-drawing the sliver twice under the condition of Needle comb strike times: 800/minute Needle comb specification: 7~10 needles/inch Weight of outlet sliver: 11.+−0.0.5 g/m 5. Combing the sliver after pre-drawing under the condition of Speed of cylinder: 90~95/minute Draw gauge: 28~48 mm Weight of outlet sliver: 40~45 g/5 m 6. Pre-drawing again after combing under the condition of Weight of outlet sliver: 40~45 g/5 m Needle comb specification: 10~13 needles/inch Needle comb strike times: 600~800/minute 7. Blending natural bamboo fiber sliver with wool sliver after combing and pre-drawing under the condition of draw ratio at the back tension: 1.037 draw ratio in the front tension: 1.011

Needle comb strike times: 600~800/minuter

Needle comb specification: 13~19 needles/inch

The weight of outlet sliver: 20~45 g/5 m

Draw ration: 7~10

8. Roving Under the Condition of

Outlet count: 2.5~3 Nm

Speed of spindle: 530 rpm

Twist factor: 20~23

Draw ratio: 10~12

9.Spinning under the condition of

Outlet count: 50 Nm

Speed of spindle: 5500 rpm

Twist factor: 90~100

Draw ratio: 10~20

10. Winding Under the Condition of

Speed of yarn: 350~400 m/minute

Weight of sheet: 7 g/sheet

11. Doubling Under the Condition of

The number of yarn fed in: two

Speed of spindle: 6000 rpm

Twist factor: 130~150

12. During spinning step, a high environmental temperature and humidity is kept. For example, the temperature is from 20 to 30° C. and the relative humidity is from 70 to 90%.

13. In the spinning step, sliver is fed at low speed, with little draw force, given proper press and proper tension and draw gauge. The treatment aims to increase yarn regularity and reduce strength unevenness.

In this example, natural bamboo fiber bundles are prepared by slivering, pre-drawing and combing the natural bamboo fiber by means of wool spinning device such as comber after said fiber being treated to improve spinnability, and then yarns are prepared by blending with wool sliver, roving, spinning, grooved drumming, combining and twining.

Example 6

The Production of 15 Nm Pure Natural Bamboo Yarn

The treatment conditions according to the technology of linen spinning system are described as below.

1. obtaining the natural bamboo fiber in a state of filament or the natural bamboo fibers in a state of processed fibers.

2. treating the natural bamboo fiber according to item 2 in example 1.

3. Selecting the natural bamboo fiber after humidifying and providing oil.

The selected natural bamboo fiber has a fiber count of more than 500 Nm, fiber strength of more than 3 CN/D and fiber average length of 50~100 mm.

4. the selected fiber is fed in combined breaker and finisher card to prepare sliver under the condition of Speed of the pin apron: 60 m/minute Hang-up of apron: 75~80 times/minute Speed of cylinder: 140 rpm Speed of doffer: 1012 rpm Speed of apron: 1~1.5 m/minute Speed of draw: 25~30 m/minute Width of draw guidance: 52~72 mm Weight of outlet sliver: 10~15 g/m The technology of carding keeps the principle of beating lightly and carding lightly, and transferring well and reducing the damage of fiber as possible.

In order to obtain good sliver, draw ratio of every part should be reduced.

5. Slivering to improve the evenness and strength of the bundle of fiber under the condition of Number of sliver: 6~8

Needle comb strike times: 800~1000/minute

Needle comb specification: 7~10 needles/inch

Tension draw ratio: 1.015~1.045

6.Roving under the condition of

Outlet count: 11.5 Nm

Speed of the front roller: 10~16 m/minute

Speed of spindle: 500 rpm

Twist factor: 30~40

7. Scouring rove under the condition of procedure of roving.fwdarw.scouring.fwdarw.washing in hot water.fwdarw.washing in cool water.

Technology parameter of

Temperature: 120~130° C.

Press: 2 kgf/cm.sup.2

Time: 1.5~2 hours

Washing in hot water at temperature of 60° C. twice and 10~15 minutes each one.

Scouring agents comprises 3~5% by weight of sodium hydroxide, 0.15~0.2% by weight of sodium carbonate, 0.3~0.4% by weight of sodium metasilicate, 0.3~0.5% by weight of sodium sulphite and 0.1~0.2% by weight of penetrant, all based on the weight of rove.

8. Bleaching rove under the condition of procedure of scouring.fwdarw.acid rinsing.fwdarw.water rinsing.fwdarw.bleaching.fwdarw.water rinsing The acid rinsing step is carried out under the condition of acid concentration of 1~1.5 g/l, at temperature of normal temperature for 10~15 minutes and then washing in cool water to be clean.

The bleaching step is carried out at temperature of 95~100° C. for 45~60 minutes and under pH of 10.5~11, and then washing in hot water at temperature of 50~60° C. for 10~15 minutes, finally washing in cool water for 10~15 minutes.

Bleaching liquid comprises 4~5 g/l of hydrogen peroxide, 7~8 g/l stabilizer, 2~3 g/l of penetrant and sodium hydroxide.

9. Spinning Under the Condition of

Speed of front roller: 12~16 m/minute

Speed of spindle: 5000~6000 rpm

Draw ratio: 9~14

Twist factor: 95~115

10. Drying at temperature of 80~100° C. for 5 hours or more and obtained moisture regain is about 7~10%.

11. Scouring and bleaching rove can be optional depend on the usage of article.

12. Feeding in light measured weight, at low speed and the draw ratio should not be too high.

13. Drawing machine preferably is an intersecting carding machine.

14. Spinning device preferably is a two bands system draft.

15. High Temperature and Relative Humidity preferably is kept in these front processes. For example, the temperature preferably is 20~30° C. and relative humidity is 65~85%.

In this example, the natural bamboo fiber in a state of filament or the natural bamboo fibers in a state of processed fibers are subjected to sliver, draw, rove and spin by means of linen spinning device such as combined breaker and finisher card after said fiber being treated to improve spinnability.

What is claimed is:

1. A process for manufacturing yarn, which comprises a preliminary step of producing natural bamboo fiber and a spinning step of spinning the natural bamboo fiber, and further comprising a step of improving spinnability of the natural bamboo fiber, said improving step comprising:

a. obtaining natural bamboo fiber;

b. selecting natural bamboo fiber; in which the requirements for selecting natural bamboo fiber are that the fiber should be straight and order, to obtain a selected natural bamboo fiber;

c. providing oil to the selected natural bamboo fiber to obtain an oil-treated natural bamboo fiber; in which the oil is a mixture of soap with emulsification oil, wherein the amount of emulsification oil is 1 to 1.8% by weight and the amount of soap is 0.5 to 0.9% by weight, both based on the weight of natural bamboo fiber; the oil is provided by immersing the fiber into oil after humidifying treatment at a temperature of 80~90° C. for 3~4 hours in a bath ratio of 1:6~8; wherein the emulsification oil comprises 47~53% by weight of plant oil, 0.04~0.06% by weight of sodium hydroxide and 47~53% by weight of water; and said plant oil has an acid number of less than 8, a saponification number of 185~195 and an iodine value of 76~83;

d. drying the oil-treated natural bamboo fiber in a dryer after dehydrating it to obtain a dried natural bamboo fiber, wherein moisture regained after drying is 5~9%;

e. humidifying by spraying and providing oil to the dried natural bamboo fiber to obtain a humidified natural bamboo fiber, wherein the oil comprises 9~10.6% by weight of kerosene, 0.3~0.5% by weight of sodium carbonate, 6~7.6% by weight of plant oil and 83~84% by weight of water; and f. stacking the humidified natural bamboo fiber for 5~7 days, wherein moisture regained is 10~15%.

2. The process according to claim 1, wherein said spinning step is carried out by using a ramie spinning system in which the length of fiber is from 70 mm to 100 mm; and the step of producing yarns comprises preparing natural bamboo fiber bundles by selecting, arranging, spreading, slivering, pre-drawing and combing the natural bamboo fiber by means of a ramie spinning device after said fiber is treated to improve spinnability, and then preparing yarns by drawing, roving and spinning.

3. The process according to claim 1, wherein said spinning step is carried out by using a cotton spinning system in which the length of fiber is from 30 mm to 50 mm; and the step of producing yarns comprises filaments produced during the combing step or filaments produced as required by spinning are subjected to clear, scotch, roll, comb, draw, rove and spin by means of a cotton spinning device.

4. The process according to claim 1, wherein said spinning step is carried out by using a silk spinning system in which the length of fiber is from 65 mm to 100 mm; and the step of producing yarns comprises preparing natural bamboo fiber bundles by spreading, slivering, pre-drawing and combing the natural bamboo fiber by means of silk spinning device after said fiber is treated to improve spinnability, and then preparing yarns by blending with spun silk, roving and spinning.

5. The process according to claim 1, wherein said spinning step is carried out by using a wool spinning system in which the length of fiber is from 65 mm to 100 mm; and the step of producing yarns comprises preparing natural bamboo fiber bundles by slivering, pre-drawing and combing the natural bamboo fiber by means of a wool spinning device after said fiber is treated to improve spinnability, and then preparing yarns by blending with wool sliver, roving, spinning, grooved drumming, combining and twining.

6. The process according to claim 1, wherein said spinning step is carried out by using a linen spinning system in which the length of fiber is from 50 mm to 100 mm; and the step of producing yarns comprises the natural bamboo fiber in a state of filament or the natural bamboo fibers in a state of processed fibers are subjected to sliver, draw, rove and spin by means of a linen spinning device after said fiber is treated to improve spinnability.

7. The process according to claim 1, wherein moisture of the fiber regained in stacking step f is between 10% and 15%.

8. The process according to claim 1, wherein the draw ratio is controlled between 5 and 10 in the step of slivering, drawing and roving.

9. The process according to claim 1, wherein the draw ratio is controlled between 10 and 30 in the spinning step.

* * * * *